US005623844A

United States Patent [19]

Draeger

[11] Patent Number: 5,623,844

[45] Date of Patent: Apr. 29, 1997

[54] KEY LEVERAGE EXTENDING APPARATUS AND METHOD

[76] Inventor: Richard L. Draeger, Rte. 2, Box 232A, Columbus, Kans. 66725

[21] Appl. No.: 254,616

[22] Filed: Jun. 6, 1994

[51] Int. Cl.[6] ..... E05B 19/04

[52] U.S. Cl. ..... 70/408; 16/110 R; 70/252; 70/395; 74/528; 74/557; 200/331

[58] Field of Search ..... 70/395, 397, 398, 70/252, 456 R, 375, 408; 74/528, 557; 200/331; 180/316, 320; 16/110 R; 81/177.2

[56] References Cited

U.S. PATENT DOCUMENTS

| | | | |
|---|---|---|---|
| 1,646,528 | 10/1927 | Fairchild | 70/252 |
| 2,906,148 | 9/1959 | Mikeska | 70/466 |
| 3,729,965 | 5/1973 | Gartner | 70/408 X |
| 3,874,204 | 4/1975 | Capri | 70/427 |
| 3,916,658 | 11/1975 | Barry | 70/252 X |
| 4,036,040 | 7/1977 | Graizzaffi | 70/456 R X |
| 4,292,995 | 10/1981 | Mazzola | 70/408 X |
| 4,324,308 | 4/1982 | Clendenen | 70/254 X |
| 4,432,218 | 2/1984 | Hoener | 70/395 |
| 4,557,124 | 12/1985 | Russ | 70/456 R |
| 4,583,383 | 4/1986 | Bosco et al. | 70/458 X |
| 4,910,983 | 3/1990 | Taylor | 70/456 R |
| 5,058,465 | 10/1991 | Womack | 70/408 X |
| 5,207,082 | 5/1993 | LeMaitre | 70/408 |

FOREIGN PATENT DOCUMENTS

| | | | |
|---|---|---|---|
| 57008 | 12/1912 | Austria | 70/397 |
| 2408468 | 3/1975 | Germany | 70/395 |

*Primary Examiner*—Lloyd A. Gall

[57] ABSTRACT

A method and apparatus for assisting in the operation of a key in a lock. A leverage extender is provided having a base member comprising a pair of opposed ends secured to a pair of opposed sides and a pair of opposed tops secured respectively to the opposed ends and the opposed sides such that a longitudinal aperture is formed therebetween. A handle member is secured to one of the opposed sides, comprising an angular disposition relative to a plane of the base and having handle sides thereof parallel to the opposed sides. At least one set screw aperture is disposed in one of the opposed sides and is adapted to threadably receiving a set screw. A set screw member is threadably disposed in the set screw aperture. The apparatus is secured to flanges of a lock cylinder and a key is passed between the top members of the leverage extender and into the lock cylinder. Force is then applied to the handle member to operate the lock cylinder. Alternatively, a head of the key is secured to the leverage extender, and the key/leverage extender combination is disposed in the lock to subsequently turn the handle member of the leverage extender and operate the lock.

12 Claims, 3 Drawing Sheets

KEY LEVERAGE EXTENDING APPARATUS AND METHOD

1. FIELD OF THE INVENTION

The present invention is related to leverage extenders, such as devices for assisting in turning an ignition key in an automobile. More specifically, the present invention provides an apparatus and method for providing additional leverage to a lock cylinder/key combination to facilitate turning the key in the keyhole of the cylinder, particularly vehicle (trucks, cars, etc.) key cylinders that are part of ignition systems for vehicles.

2. BACKGROUND OF THE INVENTION

A majority of door locks and ignition system locks involve inserting a key into a keyhole and turning the key. Keys are well known in the security industry and are normally flat-bodied and elongated devices, with the length being longer than the width. The shank of the key is the longer portion and contains cut-out portions normal to and along the shank, the cut-out portions and grooves on the shank contacting various pins and tumblers of the core of a cylinder lock, with the result that rotating the inserted key rotates the lock core to its desired location. The head of the key is an extension of the shank and is an enlarged portion of same, such that a person using the key can manually hold the key head and/or flanges of the lock cylinder, insert the shank into the keyhole, and exert torque on the head, thus completing the operation of unlocking a door or actuating an ignition switch.

A variety of physical ailments can reduce the ability of a key user to exert sufficient torque on the key in order to rotate the lock cylinder, such as carpel-tunnel syndrome, Charcot-Marie-Tooth disease, amputees, arthritis, or casts, and etc.

Certain locks, such as in some automobiles, have flanges or tabs on opposite sides of the cylinder lock keyhole to assist the user in turning the cylinder lock and/or prevent breaking the key. This assistance may not be sufficient for an infirm or disabled user to complete the desired rotation of the lock.

Accordingly, a need exists for a key leverage extender that has not been met by the prior art and that is provided by the present invention. More specifically what is needed and what has been invented by me is an apparatus and method for assisting the disabled in starting a vehicle and which is not taught or suggested by the following patents: U.S. Pat. No. 2,083,161 to Gilpin; U.S. Pat. No. 2,135,759 to Mabee; U.S. Pat. No. 2,169,796 to Gilpin; U.S. Pat. No. 2,229,525 to Sandberg; U.S. Pat. No. 2,635,328 to Larmour; U.S. Pat. No. 3,786,659 to Elder; U.S. Pat. No. 4,583,383 to Bosco; and U.S. Pat. No. 4,910,983 to Tayler.

SUMMARY OF THE INVENTION

The present invention accomplishes its desired objects by providing a leverage extender consisting of an apparatus that assists infirm or disabled users in turning a key inserted into the keyhole of a lock. The apparatus increases the leverage or torque applied to the key or key/lock cylinder combination. The apparatus comprises an elongated rectangular base having a longitudinal slot therein which is normal to the base and which is dimensioned to accommodate a key so that the shank of the key extends outwardly from the base for insertion into the lock, such as locks for ignitions, entry doors, etc. The head of the key extends from the slot in a position opposite the shank, with enough contact between the key head and the sides of the slot so that a suitable torque can be transmitted from the sides of the slot to the key head and/or lock cylinder and further transmitted along the shank so as to actuate the lock. The upper surface of the apparatus has an arcuate profile along the slot, forming a recess so as to accommodate a portion of the key head. At least one threaded aperture is disposed in one of the sides of the apparatus adapted for threadably receiving a fastening member, such as a screw, to fixedly hold the leverage extender against flanges or tabs found on opposite sides of the cylinder lock keyhole. The leverage extender is thus held to the cylinder lock and the key is passed through the longitudinal slot and inserted into the cylinder lock. Subsequently, torque is applied to the leverage extender and transmitted to the key and/or key/lock combination, and the key and cylinder lock are moved to an operable position. Alternatively, the leverage extender is secured to the head of the key with a set screw member and the leverage extender/key combination is passed into the lock cylinder to operate same. While the present invention is particularly suited for vehicles such as trucks and automobiles, it is to be understood that the spirit and scope of the present invention includes in applicable situations utility for use with a boat key, house key, and other keyed entry or ignition systems.

Many automobile ignition locks are located on the steering column, and the present assisting apparatus can be fixedly held to the flanges or tabs of the lock, as mentioned above. If the ignition lock is located on the dashboard, there may or may not be flanges or tabs associated with the ignition lock cylinder. If tabs are present, the leverage extender can be attached to the tabs, as described above. If tabs are not present, the key can be inserted in the slot of the leverage extender and the aforementioned screw or fastener can be used to hold the key in the leverage extender, such that the key and apparatus are handled as a unit. This unit is held by the user so the key is inserted in the lock keyhole, and sufficient torque is applied to the unit to move the ignition lock to the desired position.

It is further an object of the present invention to provide a method for providing additional leverage to the rotation of a key in a lock comprising the steps of: providing a key; providing a lock assembly having opposed protruding flanges or lugs or ears thereof for turning same; providing a leverage extending apparatus having a base member comprising a pair of opposed ends secured to a pair of opposed sides and a pair of opposed tops secured respectively to the opposed ends and the opposed sides such that a longitudinal aperture is formed therebetween, and a handle member is secured to one of the opposed sides comprising an angular disposition relative to a plane along the base and having handle sides parallel to the opposed sides, and at least one set screw aperture disposed in one of the opposed sides adapted for threadably receiving a set screw, and a set screw member threadably disposed in the set screw aperture. The method further comprises fitting the leverage extending apparatus over the flanges of the lock cylinder; securing the leverage extending apparatus to the flanges of the lock cylinder with the set screw; passing the key through the leverage extending apparatus and into said lock cylinder; and turning the handle of the leverage extending apparatus to turn the key in the lock.

It is further yet an object of the invention to provide a method for providing additional leverage to a key in a lock comprising the steps of: providing a key; providing a lock assembly; providing a leverage extending apparatus having a base member comprising a pair of opposed ends secured to a pair of opposed sides and a pair of opposed tops secured respectively to the opposed ends and the opposed sides such that a longitudinal aperture is formed therebetween, and a handle member is secured to one of the opposed sides comprising an angular disposition relative to a plane along the base and having handle sides parallel to the opposed sides, and at least one set screw aperture disposed in one of the opposed sides adapted to threadably receiving a set screw, and a set screw member threadably disposed in the set screw aperture. The method additionally comprises disposing the key in the leverage extending apparatus such that a head of the key abuts one of the opposed ends, and one of the opposed sides, and one of the opposed tops, and such that the key head is disposed opposite the set screw disposed in the at least one set screw aperture; tightening the set screw member against the key head to fixedly wedge the key head against the one opposed side; disposing the key and the leverage extending apparatus in the lock; and turning the handle of the leverage extending apparatus to turn the key in the lock.

It is therefore an object of the invention to provide an apparatus and method for providing additional leverage to a lock cylinder/key assembly.

These, together with the various ancillary objects and features which will become apparent to those skilled in the art as the following description proceeds, are attained by this novel method for and apparatus, a preferred embodiment as shown with reference to the accompanying drawings, by way of example only, wherein;

DETAILED DESCRIPTION OF THE INVENTION

Figure 1A:
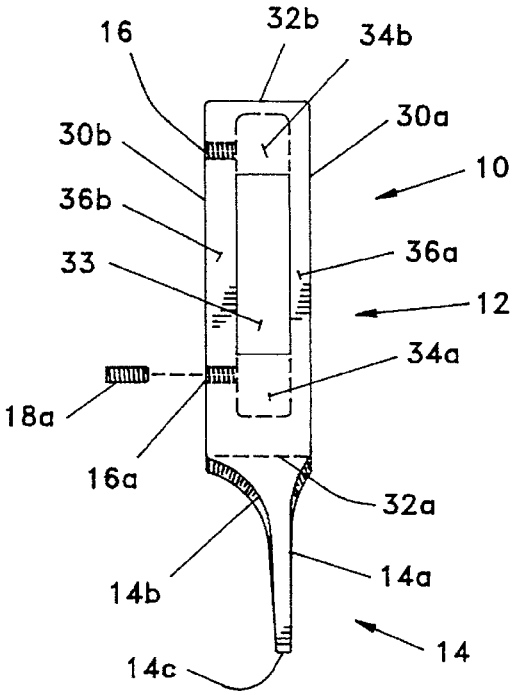
FIG. 1A is a top plan view of the leverage extender of the invention, having associated set screw members removed therefrom.

Turning now to the drawings wherein similar parts of the invention are identified by like reference numbers, a preferred embodiment of the key leverage extender is seen in FIG. 1A and generally indicated as 10. The leverage extender 10 comprises a generally rectangular base member 12 having at least one handle member 14 protruding therefrom. The base member 12 has at least one set screw aperture 16 which is adapted to threadably receive at least one set screw member 18.

Figure 1B:
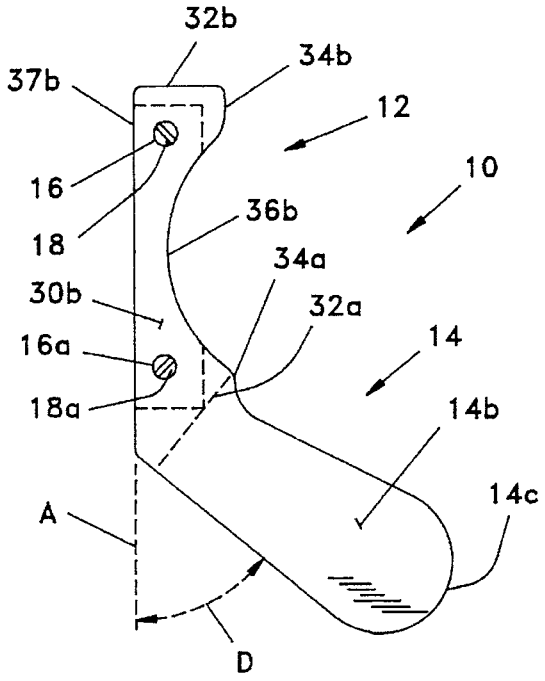
FIG. 1B is a side elevational view of the leverage extender of FIG. 1A.

The base member 12 comprises a pair of longitudinal opposed sides **30*a*–30*b* secured to a first end 32*a* and a second end 32*b*. A first top member 34*a* is secured to the opposed sides 30*a*–30*b* and the first end 32*a* and a second top member 34*b* is secured to second end 32*b* and opposed sides 30*a*–30*b*. As best shown by FIG. 1A, a key opening or aperture 33 is formed between the first top member 34*a* and the second top member 34*b*, such that a key may be passed therethrough. The handle member 14 comprises a structure defining a generally flat plate member which is angularly disposed relative to the base member 12, as best shown in FIG. 1B, for grasping and subsequently turning to facilitate turning of the base. More specifically, base member 12 is parallel to line A shown in FIG. 1B, and handle member 14 is angularly disposed relative to a plane A along the base 12, forming an angle D therebetween of from about 5 degrees to about 90 degrees. For the embodiment pictured in FIG. 1B, angle D measures about 47 degrees. The handle member 14 comprises first side 14*a* and second side 14*b* thereof, and for the embodiment pictured, the handle 14 is formed with an arcuate end 14*c*. It is understood that a non-arcuate end may be employed equally well without departing from the spirit and scope of the invention. Handle member 14 is secured to first end 32*a* or integrally formed therewith and has sides 14*a*–14*b* thereof generally parallel to sides 30*a*–30*b* of the base member 12. As best shown in FIGS. 1A and 1B, the handle member 14 additionally is formed with a pair of opposed curved sections which are integrally formed in the handle member 14 and which interconnect the base member 12. It should be appreciated that the base member 12 and the handle member 14 may form one contiguous piece, as may be preferred in the process of manufacturing the leverage extender 10**, and that such a contiguous piece is intended and should not limit the spirit and/or scope of the invention. The leverage extender may be manufactured of any suitable material, such as aluminum, magnesium, alloys, or the like.

Figure 1C:
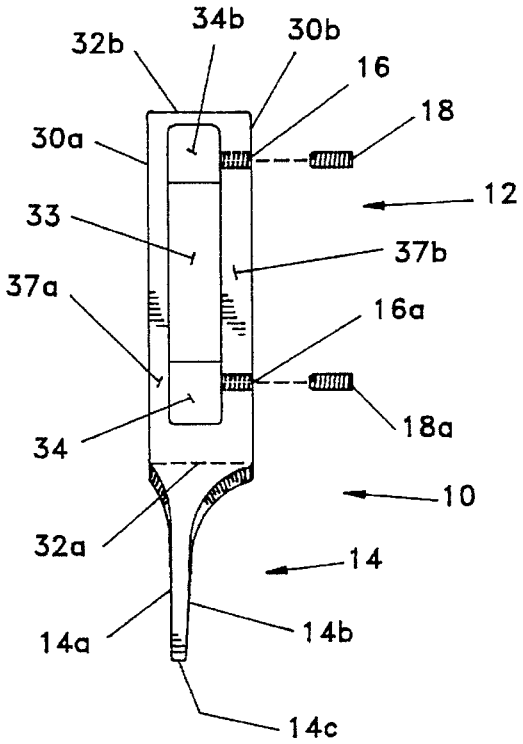
FIG. 1C is a bottom plan view of the leverage extender of FIG. 1A.
Figure 2:
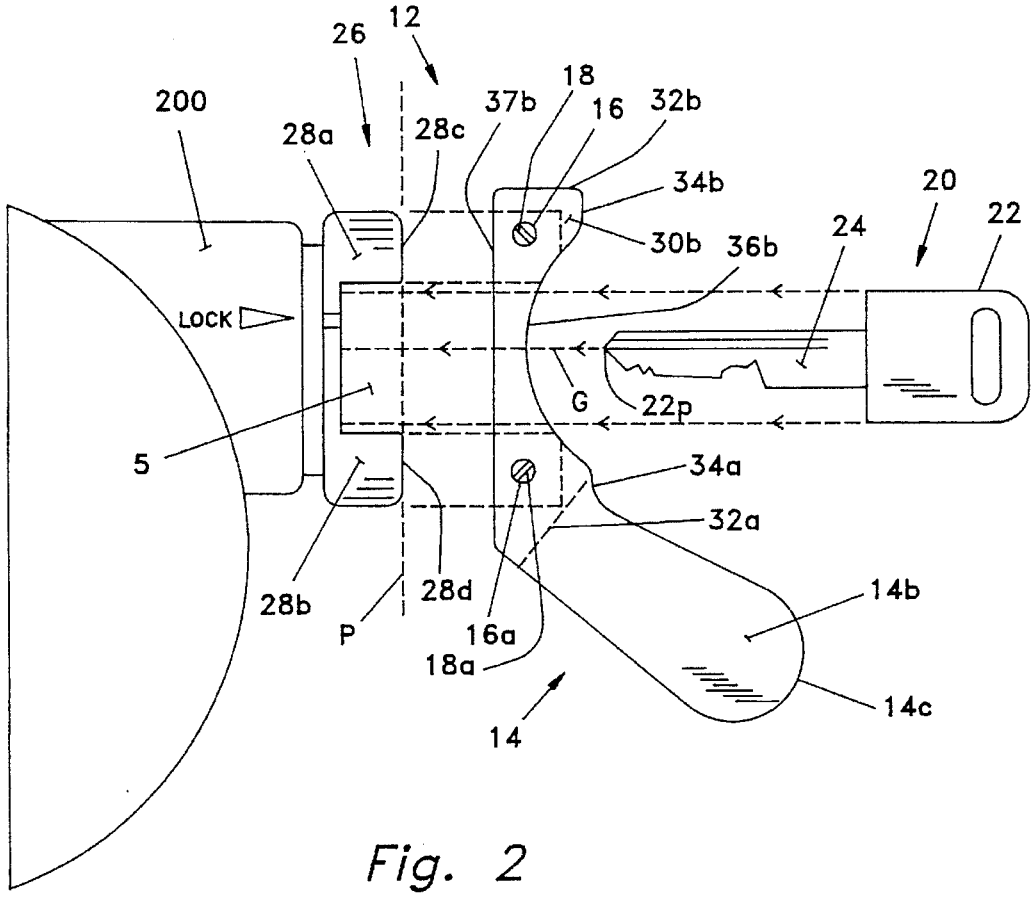
FIG. 2 is a side elevational view of the leverage extender with the dashed lines indicating installation of same on an automobile ignition terminal having a lock cylinder and flanges, and a key for being inserted into same.
Figure 3A:
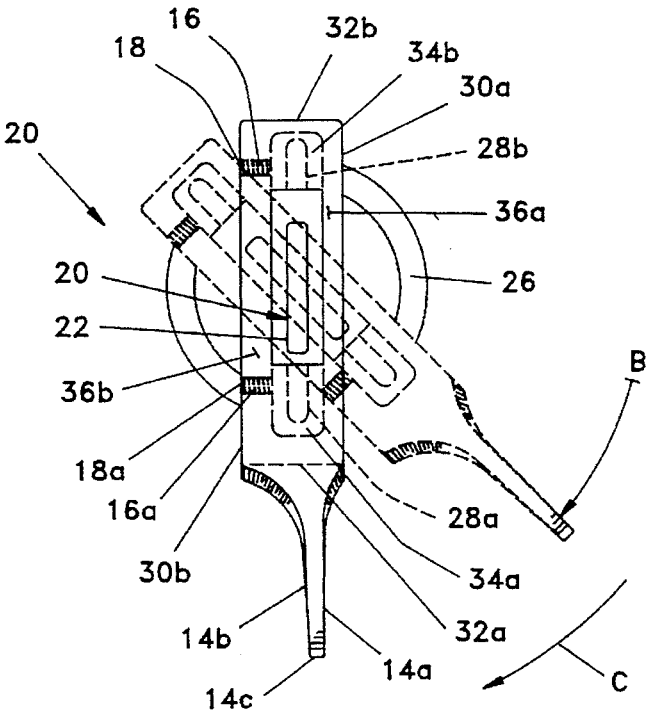
FIG. 3A is an end view of the ignition terminal, the leverage extender, and the key, with dashed lines indicating an off position of the ignition terminal, wherein lines B and C indicate a direction of travel and a point of applied force.
Figure 3B:
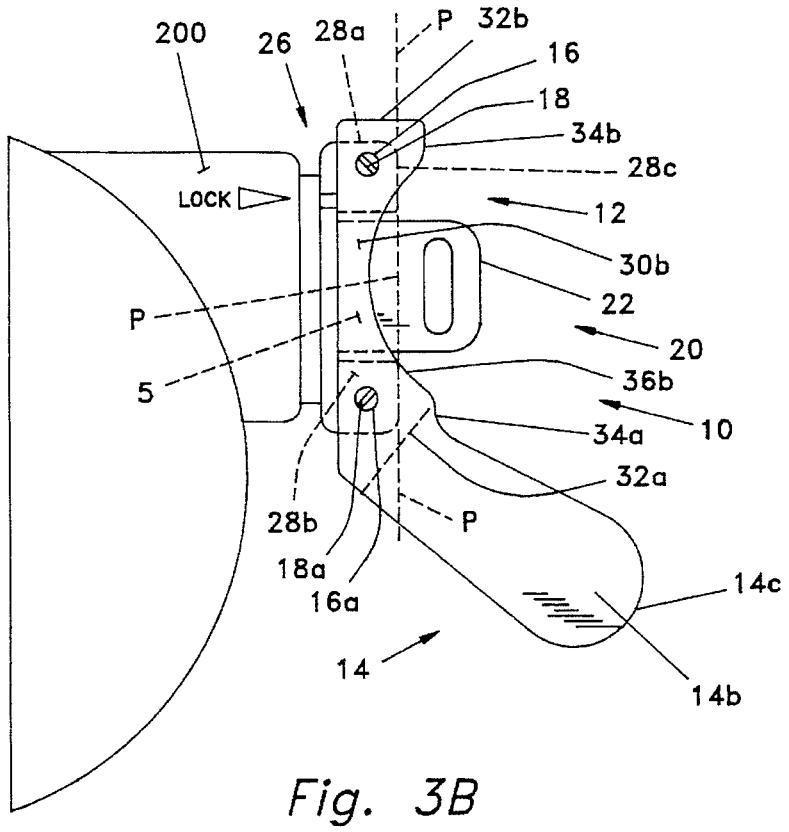
FIG. 3B is a side elevational view of the ignition terminal, the leverage extender, and the key, with the leverage extender disposed on the lock cylinder, and the key installed in the lock cylinder.

The opposed sides **30*a*–30*b* comprise a structure defining C-shaped cut-out sections or curved or arcurate top edges 36*a*–36*b* thereof, for exposing a larger surface area of a key head 22 of a key 20 that remains exposed when the key 20 is disposed within the apparatus and to facilitate easy removal of the key therefrom (see FIG. 3B). The opposed sides 30*a*–30*b* further comprise respective bottom edges 37*a*–37*b*, as shown in FIG. 1C. As previously mentioned, set screw aperture 16 is disposed in the base 12 for threadably receiving set screw member 18. As best shown in FIG. 1A, the set screw aperture 16 and the set screw 18 are disposed in side 30*b* of the base 12. Preferably, a pair of apertures 16–16*a* are disposed in opposed ends of side 30*b* and adapted for respectively receiving a pair of set screws 18–18*a*. As best shown in FIG. 2, the set screw apertures 16–16*a* and set screws 18–18*a* disposed therein are arranged such that ears 28*a*–28*b* of an ignition terminal 26 are engaged thereby when the leverage extender 10 is placed thereon to secure same to the ignition terminal 26. Ignition terminal 26 is of the type typically found in automobiles and the like, comprising a rotary lock cylinder having a keyhole which rotates about a matching key, such as key 20. Key 20 is then disposed between top members 34*b*–34*a* and into the ignition terminal 26, such that head 22 of key 20 protrudes from the ignition terminal 26 and the curved top edges 36*a*–36*b* of the leverage extender 10**, as shown in FIG. 3B.

Figure 4A:
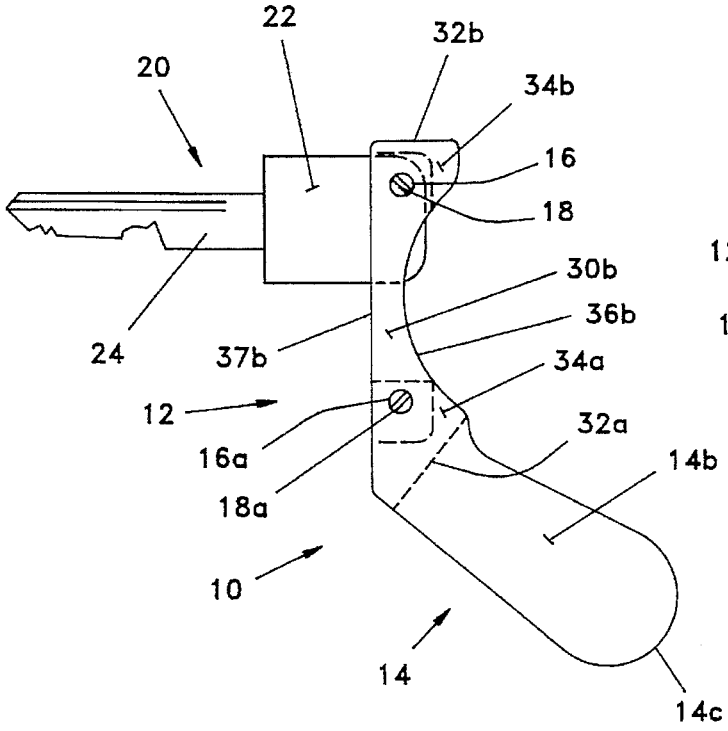
FIG. 4A is a side elevational view of another embodiment of the present invention wherein a leverage extender has a key secured thereto with a set screw.
Figure 4B:
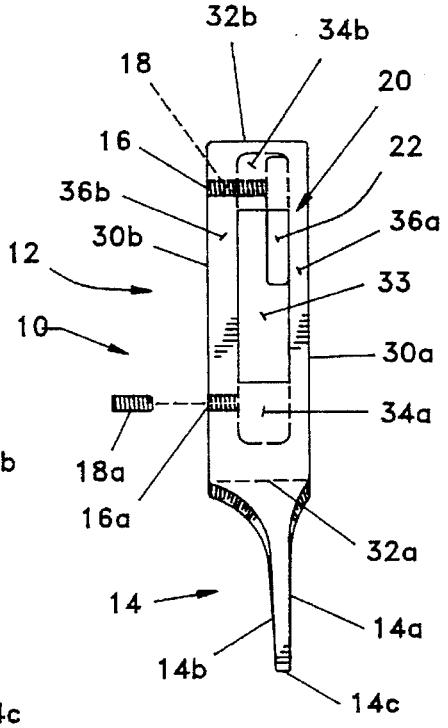
FIG. 4B is a top plan view of the view depicted in FIG. 4A.

It may be appreciated that in an alternative embodiment and/or use of the invention, key 20 may be directly secured to the leverage extender 10, rather than having the leverage extender 10 secured to the ignition terminal 26. As best shown in FIGS. 4A and 4B, key head 22 of key 20 is disposed between sides 30*b*–30*a* of the leverage extender 10 such that the key head 22 abuts end 32*b* and top 34*b* of same. Set screw 18 is then disposed in aperture 16 and tightened to wedge the key head 22 against side 30*a* and fixedly hold same therein. The key 20 and leverage extender 10 assembly are then inserted into the ignition terminal 26, or any other suitable lock member for which additional leverage is desired to operate.

Continuing to refer to the drawings for operation and use of the invention, the leverage extender 10 is provided for securing around a key, such as key 20, to provide additional leverage thereto in the operation of turning the key. The leverage extender 10 is placed over the ears 28*a*–28*b*, as shown in FIG. 2, such that the ears 28*a*–28*b* pass between the sides 30*a*–30*b* and abut against the top members 34*a*–34*b* of the base member 12. Set screws 18–18*a* are disposed in apertures 16–16*a* of the base member 12 and threadably tightened to secure the ears 28*a*–28*b* of the ignition terminal 26 to the leverage extender 10. Key 20 is passed between top members 34*a*–34*b* and side members 30*a*–30*b* of the leverage extender and into the ignition terminal 26. Force is applied to the distal end of the handle member 14 as shown in FIG. 3A in the direction of arrow B to cause the ignition terminal 26 and the leverage extender 10 to rotate in the direction of arrow C about key 20 and thereby operate the lock. As it may be appreciated, less force is required to cause the distal end of the handle member 14 to rotate.

Thus by the practice of the present invention there is provided an apparatus for extending leverage exerted on a combination lock cylinder and key in an automobile. The combination comprises the rectangular base member 12 having the opposed sides 30*a*–30*b* (see FIG. 1A) secured to the opposed ends 32*a*–32*b*, and top members 34*a*–34*b*. The aperture 33 is formed between the two top members 34*a*–34*b*, and the handle member 14 is secured to one of the opposed ends, as shown in FIG. 1A. The handle comprises the flat structure, as previously mentioned, having opposite sides 14*a*–14*b* thereof, and having an angular disposition relative to the bottom plane of the base 12, as shown in FIG. 1B, with opposite sides 14*a*–14*b* parallel to the base 12. As further previously mentioned, the handle member 14 additionally comprises the pair of opposed curved sections which are integrally formed in the handle member 14 and which interconnect the base member. As mentioned, the base comprises the aperture 16 for threadably receiving the set screw 18, and has top edges 36*a*–36*b* thereof which have an arcuate or curved face such that the edges 36*a*–36*b* generally define the C-shaped or concave cut out section (see FIG. 1B).

Further, by practice of the present invention there is provided the method for providing additional leverage to the key 20 in the lock 26. The method assists persons with various ailments, such as by way of example only carpel tunnel syndrome, Charcot-Marie-Tooth disorder, arthritis, broken hands or broken arms in turning the key in the lock. The method comprises providing the key 20; providing the lock 26 (see FIG. 2) having the flanges 28*a*–28*b* protruding therefrom; providing the apparatus 10 having the base 12, the handle member 14, the set screw 18 disposed in the aperture 16; fitting the apparatus 10 over the flanges 28*a*–28*b* of the lock 26 (see FIG. 2); securing the apparatus 10 to the flanges 28*a*–28*b* with the set screw; passing the key 20 through the apparatus 10 and into the lock 26; and turning the handle 14 of the apparatus 10 to apply turning force to the lock 26 and cause the lock 26 to turn. In an alternative embodiment of the above-described method, the method for extending leverage on the key 20 in the lock 26 comprises the steps of providing the key 20, the lock 26, and the apparatus 10; the key 20 is disposed in the apparatus 10 such that the head 22 of the key abuts one of the opposed ends 32*b*, one of the opposed tops 34*b*, and one of the opposed sides 30*a*, and such that the key head 22 is disposed opposite the set screw 18 and the aperture 16; tightening the set screw 18 against the key head 22 to fixedly wedge the key head 22 against the opposed side 30*a*; disposing the key 20 and the apparatus 10 in the lock 26; and turning the handle 14 of the apparatus 10 to turn the key 20 in the lock 26.

One of the features of the present invention is that the flanges 28*a* and 28*b* are opposed to an extent to define a volumetric space S (see FIG. 2) therebetween, and the arcuate top edges 36*a*–36*b* (as best shown in FIG. 3B) pass down or inwardly towards an ignition terminal 200 such as to intercept and extend underneath a plane P along respective faces 28*c* and 28*d* of 28*a* and 28*b* and superimposedly over the volumetric space S for sandwiching the same. This allows a point 22*p* of the key 22 to enter through the leverage extender 10 (i.e. between the opposed sides 30*a*–30*b*) at a point G which is closer to the ignition terminal 200 than if the opposed sides 30*a*–30*b* did not contain the arcuate top edges 36*a*–36*b* and were essentially straight. This facilitates the guiding of the point 22*p* of the key 22 into the ignition terminal 200.

While the present invention has been described herein with reference to a particular embodiment thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A method for providing additional leverage to a key in a lock comprising the steps of:

(a) providing a key;

(b) providing a lock assembly;

(c) providing a leverage extending apparatus having a base member comprising a pair of opposed ends secured to a pair of opposed sides and a pair of opposed tops secured respectively to said opposed ends and said opposed sides such that a longitudinal aperture is formed therebetween, a handle member secured to one of said opposed sides comprising an angular disposition relative to a plane of said base member and having handle sides thereof generally parallel to said opposed sides, at least one set screw aperture disposed in one of said opposed sides adapted to threadably receive a set screw, and a set screw member threadably disposed in said set screw aperture;

(d) disposing said key of step (a) in said leverage extending apparatus such that a head of said key abuts one of said opposed ends, one of said opposed sides, one of said opposed tops, and such that said key head is disposed opposite said set screw member disposed in said at least one set screw aperture;

(e) tightening said set screw member against said key head to fixedly wedge said key head against said one opposed side;

(f) disposing said key and said leverage extending apparatus in said lock assembly; and (g) turning said handle member of said leverage extending apparatus to turn said key in said lock assembly.

2. The method of claim 1 wherein said angular disposition of said handle member relative to said plane of said base comprises an angle of about 45 degrees.

3. The method of claim 2 wherein each of said opposed sides comprise a structure defining an arcuate edge thereof.

4. An apparatus for extending leverage exerted on a combination lock cylinder and key in an automobile comprising a rectangular base member; said rectangular base member comprising a pair of opposed sides secured to a pair of opposed ends; a pair of top members secured to said opposed sides and said opposed ends; a longitudinal aperture formed between said pair of opposed top members wherethrough a key may pass; a handle member secured to one of said opposed ends; said handle member comprising generally flat plate member extending from one of said pair of ends of said base member; said generally flat plate member comprising an angular disposition relative to a bottom plane of said base member; and said handle member having handle sides thereof generally parallel to said opposed sides; at least one aperture disposed in one of said opposed sides adapted to receive a screw means; and a screw means disposed in said aperture.

5. The apparatus of claim 4 wherein said opposed sides additionally comprise curved top edges thereof; said curved top edges defining a generally C-shaped cut out section having a concave profile for providing a key grasping area.

6. A method for providing additional leverage in turning a key in a lock cylinder comprising the steps of:

(a) providing a key;

(b) providing a lock cylinder, having flanges protruding therefrom for turning said lock cylinder;

(c) providing an apparatus for extending leverage of a key having a base member, a handle member, and at least one set screw member, wherein said base member is adapted for fitting onto flanges of a lock cylinder, and wherein said base member is adapted for passing a key therethrough;

(d) fitting said apparatus over said flanges of said lock cylinder;

(e) securing said apparatus to said flanges of said lock cylinder with said at least one set screw member;

(f) passing said key through said apparatus and into said lock cylinder; and (g) turning said handle member of said apparatus to apply turning force to said lock cylinder to cause said lock cylinder to turn.

7. The method of claim 6 wherein said handle member comprises an angular disposition relative to said base member; said angular disposition of said handle member comprising an angle of about 45 degrees relative to a bottom plane of said base member.

8. The method of claim 7 wherein said base member is defined by a pair of opposed sides interconnected to a pair of opposed ends; and wherein each of said opposed sides comprise a structure defining an arcuate edge thereof.

9. The method of claim 7 wherein said base member of said apparatus comprises arcuate top edges thereof.

10. The method of claim 9 additionally comprising passing said arcuate edges of said apparatus over said volumetric space to intercept a plane along the faces of the flanges and to extend beyond said plane.

11. The method of claim 6 wherein said lock cylinder additionally comprises a volumetric space between said flanges; said flanges additionally comprising faces thereof.

12. A method of assisting persons with Carpel Tunnel Syndrome, Charcot-Marie-Tooth disorder, Arthritis, broken hand bones, or the like, in the turning of a key in a lock by providing additional leverage on the lock comprising the steps of:

(a) providing a key;

(b) providing a lock having opposed flanges thereof and a leverage extending apparatus secured thereto, said leverage extending apparatus having a base member comprising a pair of opposed ends secured to a pair of opposed sides and a pair of opposed tops secured respectively to said opposed ends and said opposed sides such that a longitudinal aperture is formed therebetween, a handle member secured to one of said opposed sides comprising an angular disposition relative to a plane of said base member and having handle sides thereof generally parallel to said opposed sides, at least one set screw aperture disposed in one of said opposed sides adapted to threadably receive a set screw, a set screw member threadably disposed in said set screw aperture, and said at least one set screw member being threadably engaged to one of said opposed flanges;

(c) passing said key through said apparatus and into said lock; and (d) turning said handle member of said apparatus to apply force to said lock to provide additional leverage, as necessary to cause said lock to turn.

* * * * *